US006698065B2

(12) United States Patent
Lauer

(10) Patent No.: US 6,698,065 B2
(45) **Date of Patent: *Mar. 2, 2004**

(54) SELF-STANDING HAND HELD MARKING IMPLEMENTS

(75) Inventor: Jennifer L. Lauer, P.O. Box 756, Wilmette, IL (US) 60091

(73) Assignee: Jennifer L. Lauer, Wilmette, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/173,147

(22) Filed: Jun. 17, 2002

(65) Prior Publication Data

US 2003/0019078 A1 Jan. 30, 2003

Related U.S. Application Data

(63) Continuation-in-part of application No. 09/596,095, filed on Jun. 16, 2000, now Pat. No. 6,490,760.

(60) Provisional application No. 60/298,473, filed on Jun. 15, 2001.

(51) Int. Cl.[7] ..... B25G 3/00; B25G 1/04; A45C 13/26

(52) U.S. Cl. ..... 16/436; 16/430; 16/110.1; 16/902; 16/DIG. 12; 401/268

(58) Field of Search ..... 16/436, 430, 110.1, 16/902, 903, DIG. 12, DIG. 19; 446/325, 326; 15/167.1, 167.2, 143.1, 435–439; 30/142, 322, 323, 324, 327; D4/104, 112, 138; 401/268, 284, 285, 289, 290, 291

(56) References Cited

U.S. PATENT DOCUMENTS

| | | | | |
|---|---|---|---|---|
| 1,211,062 A | | 1/1917 | Bowman | |
| 1,347,307 A | | 7/1920 | Thomas | |
| 1,625,003 A | | 4/1927 | Walker | |
| 1,630,137 A | * | 5/1927 | Ruwwe | 446/325 |
| 1,659,622 A | * | 2/1928 | Atamian | 401/131 |
| 1,690,311 A | * | 11/1928 | Reich | 206/362.3 |
| 1,984,081 A | | 12/1934 | Pisculli | |
| 2,592,192 A | | 4/1952 | Sandford | |
| 2,632,977 A | | 3/1953 | Valasek | |
| 2,724,894 A | | 11/1955 | LaTour | |
| 2,853,780 A | * | 9/1958 | Bull | 30/327 |
| 3,442,045 A | * | 5/1969 | Green | 446/297 |
| 3,805,444 A | | 4/1974 | Adickes | |
| 4,129,963 A | | 12/1978 | Perry, Jr. et al. | |
| 4,563,816 A | | 1/1986 | Japper | |
| 4,621,387 A | * | 11/1986 | Noser | 15/167.1 |
| 4,993,156 A | | 2/1991 | Craven | |
| 5,058,279 A | | 10/1991 | Mars | |
| 5,060,386 A | | 10/1991 | Mars | |
| 5,068,967 A | | 12/1991 | Mars | |
| 5,457,448 A | * | 10/1995 | Totsuka et al. | 340/825.72 |
| D368,833 S | | 4/1996 | Gibson et al. | |
| 5,797,885 A | * | 8/1998 | Rubin | 604/192 |
| 5,860,190 A | | 1/1999 | Cano | |
| D412,813 S | | 8/1999 | Roskind et al. | |
| 5,956,796 A | | 9/1999 | Lodato | |
| 6,076,223 A | * | 6/2000 | Dair et al. | 15/167.1 |
| 6,168,034 B1 | * | 1/2001 | Perrone | 215/11.1 |

FOREIGN PATENT DOCUMENTS

| | | | |
|---|---|---|---|
| DE | 29601254 U1 | * | 6/1996 |
| GB | 2290481 A | * | 1/1996 |

OTHER PUBLICATIONS

Disney BabiesSee & Do Feeding Set Brochure and Trademark Data (2 pages) (1999).

* cited by examiner

*Primary Examiner*—Chuck Y. Mah
(74) *Attorney, Agent, or Firm*—Polit & Erickson, LLC

(57) ABSTRACT

A marking implement includes a structure which is capable of automatic orientation in an upright position upon a horizontal surface. The structure includes a weighted base having a substantially rounded and convex exterior, and adapted to support the marking implement vertically upon a horizontal surface. A handle extends between a making head and the weighted base.

20 Claims, 4 Drawing Sheets

SELF-STANDING HAND HELD MARKING IMPLEMENTS

This application is a continuation-in-part of U.S. Ser. No. 09/596,095, filed Jun. 16, 2000, now U.S. Pat. No. 6,490, 760, and also claims the benefit of provisional application Serial No. 60/298,473 filed Jun. 15, 2001.

BACKGROUND OF THE INVENTION

The invention relates to hand held implements such as a tools, instruments or utensils. The invention particularly relates to eating utensils, toothbrushes, paintbrushes, or other hand held implements.

Many hand held implements are comprised of elongated bodies which must be set down in a horizontal orientation on a supporting surface, absent a separate holder or rack for supporting the implement in a vertical orientation. In such a horizontal orientation, the working end of the implement can come into contact with the surface. Such contact can result in an unsanitary condition on the working end, such as in the case of a toothbrush or a spoon, or in a contamination or soiling of the surface by the working end, such as in the case of a paintbrush.

The present invention recognizes that it would be desirable to provide an implement which overcame these drawbacks.

As most parents know, teaching young children to feed themselves with an eating utensil, typically a spoon, can be a difficult and frustrating challenge. This is particularly true of children less than two years old, who are in the process of developing eye-hand coordination. Picking up a spoon in a conventional way adds to this difficulty.

As in the case of eating utensils, it is also difficult for young children to pick up horizontally positioned art implements, such as paintbrushes, markers and other art related implements.

The present invention recognizes that these difficulties in picking up elongated implements, although typically experienced by young children, may also be experienced by the elderly or handicapped persons, or by persons working in demanding, hostile or close quarters environments or by persons otherwise preoccupied with other tasks. The present invention recognizes the desirability of providing an implement that helped to overcome these difficulties.

SUMMARY OF THE INVENTION

The invention provides a self-standing, hand held implement that, when set down on a supporting surface, automatically assumes a vertical, standing orientation, holding a working end portion of the implement above and clear of the supporting surface. The hand held implement of the invention includes a rounded and weighted base end which assists in rotatably righting the implement if it is set down or knocked toward a horizontal orientation.

The present invention is adaptable to many types of hand held implements such as eating or serving utensils; kitchen gadgets such as potato peelers and lemon zesters; tools; hand tools such as screwdrivers; flashlights; toothbrushes; paintbrushes; fine work tools such as for jewelry, electronics, assembly, and model making work; writing instruments; markers; art implements; medical and dental instruments; beauty implements such as makeup brushes, makeup applicators, and grooming tools; shaving razors and other hand held implements.

The implement of the invention automatically assumes a vertical orientation on a support surface which helps to prevent the working end portion from contaminating, or being contaminated by, the support surface. As examples, this could be an important advantage for a paintbrush to prevent dabbing paint from the brush head onto the support surface, or for a toothbrush or a medical or dental instrument to prevent contamination of the brush head or the instrument head by contact with the support surface. The implement assumes a vertical orientation which is more readily found and gripped by a user. This is important where the user is a small child, elderly or handicapped person, or the user is working under hostile, close quarters or demanding conditions, such as a mechanic working beneath an automobile, or a medical or dental practitioner who is otherwise preoccupied with other tasks during a medical or dental operation, or by a person wearing gloves.

The present invention is particularly useful for implements used by young children. For example, in a first illustrated embodiment of the present invention, an eating utensil is provided which assists young children in learning to feed themselves.

The eating utensil is capable of automatic re-orientation into an upright orientation when placed upon a horizontal surface. The eating utensil includes a weighted base having a substantially rounded and convex exterior, and which is adapted to support the eating utensil from the horizontal surface. The eating utensil includes a working end portion in the form of a head for holding food. The eating utensil includes a handle extending between the base and the head. The handle can be fixedly connected to, or formed integrally with, the base and the head. The handle can have an exterior with a maximum diameter adjacent to the base and a minimum diameter adjacent to the head. The exterior of the handle is preferably shaped to taper from the maximum diameter to the minimum diameter.

Since the eating utensil of the invention will automatically orient itself in an upright position because of its shape and weighted base, regardless of its original position, a child can simply reach out with one hand and grasp the handle without having to twist or bend his or her wrist. The present invention utensil makes use of the eating utensil very easy to thereby assist the child in self-feeding, particularly as a first stage in learning this task. Moreover, in orientating itself into the upright position from some other original position, the eating utensil will inherently tend to "wobble" back and forth. This movement attracts the attention of the young child and further assists in motivating the child to use the eating utensil in feeding himself or herself.

In a second illustrated embodiment of the invention configured as a toothbrush, the toothbrush includes a brush head, as the working end portion, an elongated handle and a weighted base. The weighted base, as in the case of the eating utensil, is substantially rounded and convex. After a child or adult has used a toothbrush, merely placing the toothbrush down onto a supporting surface, such as a bathroom countertop, will cause the toothbrush to automatically right itself to a vertical position. This minimizes countertop space otherwise occupied by a horizontally oriented toothbrush, and also furthers a sanitary need to maintain the brush head away from the sink countertop where some standing water or other undesirable condition can contaminate the brush head.

In a third illustrated embodiment of the invention configured as a paintbrush, the paintbrush includes a brush head, as the working end portion, connected by an elongated handle to a weighted base. As with the prior two embodiments, the weighted base is substantially rounded and convex. In use, after a paintbrush has been dipped into paint, that is, a supply of paint is applied to the brush head, the brush can be set down without fear that the brush head will contaminate the supporting surface. The weighted base acts to automatically right the paintbrush into a vertical orientation.

In a fourth illustrated embodiment, a shaving razor includes a weighted base having a substantially rounded and convex exterior. As with the other embodiments, the weighted base is of a mass and dimension to automatically orient the shaving razor in a vertical orientation when the base is placed upon a horizontal surface. A razor blade is spaced from the base, the razor including a cutting edge for shaving. A handle extends between the base and the razor blade.

Although a limited number of embodiments are described, it is clear that the principle of the invention applied to implements of various types renders those implements more useful, more sanitary, and less likely to contaminate or soil surrounding surfaces.

It is also foreseen that the overall shape of the implement, especially the relatively large rounded base, and weight distribution of the implement of the invention achieve an improved handling of the implement during use, especially when fit into the small hand of a child.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
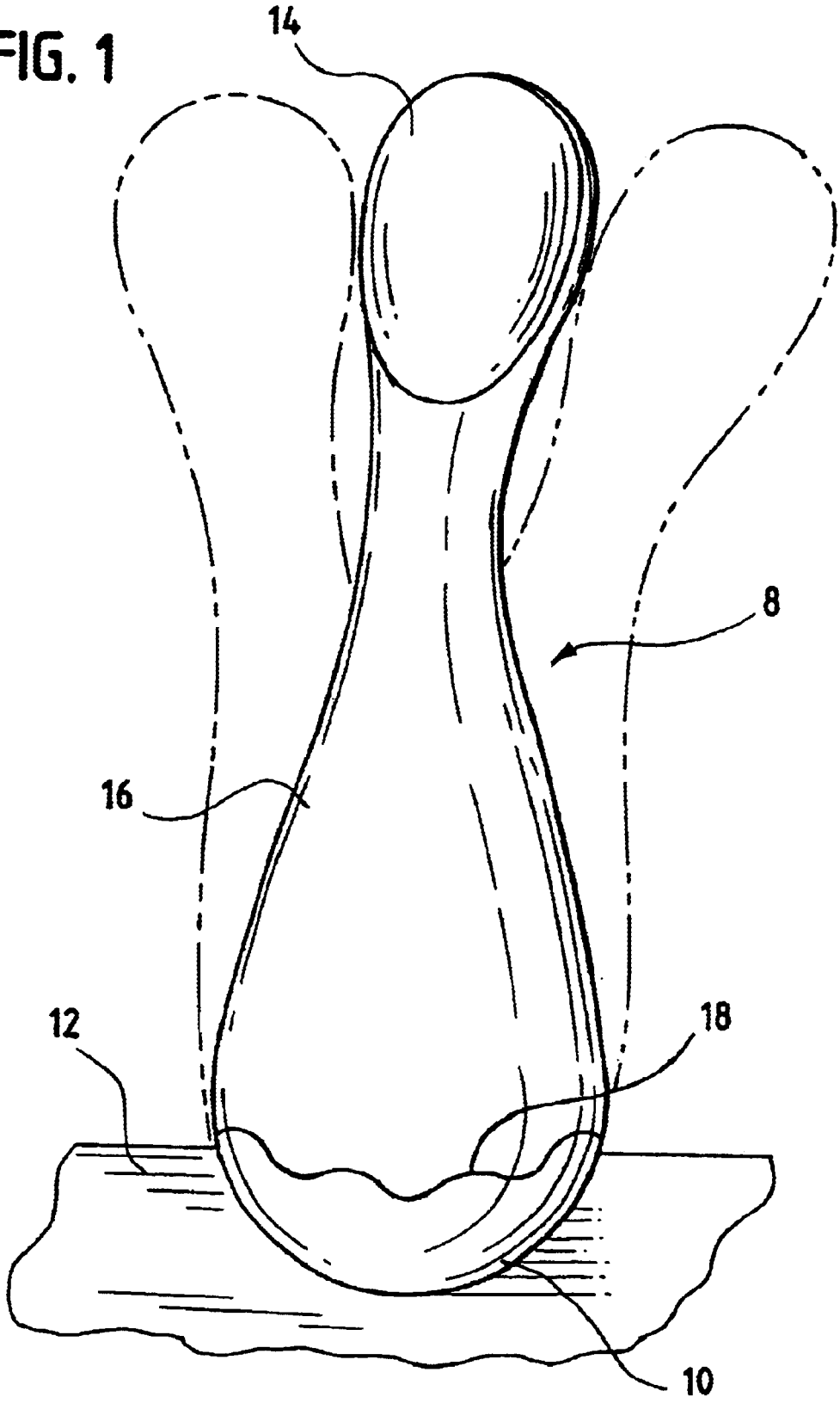
FIG. 1 is a perspective view of one embodiment of the hand held implement of the invention, as embodied in an eating utensil, shown supported upon a horizontal surface.

While this invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

Referring to FIG. 1, a self-standing hand held implement 8, such as an eating utensil, includes a weighted (as described further below) base 10 having a substantially rounded and convex exterior. The base 10 is adapted to support the implement upon a horizontal surface 12. The implement includes a working end portion such as a head 14 for performing the desired task of the implement. The implement of the illustrated embodiment is a spoon having a bowl-shaped head as the working end portion, although the head could have any form suitable for holding or manipulating food. For example, the eating utensil could be a fork having a head with tines, or a utensil having a short flat surface.

A handle 16 extends between the base 10 and the head 14, and has an exterior with a maximum diameter adjacent to the base 10 from which the handle tapers to a minimum diameter adjacent to the head 14. Preferably, the maximum diameter is about 2 to 4 times the minimum diameter. The handle 16 has a lower end thereof, of the maximum diameter, fixedly connected to the upper end of the base 10, so as to form an outer seam 18, which is shown as being generally scalloped in shape for ornamental purposes. The base 10 could be of a different color or texture than the handle 16 to optimize the visual appeal to the user. This is particularly advantageous in the case of use by a child. The upper portion of the handle 16 is preferably integral with the head 14, as shown.

The eating utensil as shown in solid lines is in its upright position, with the common longitudinal axis 28 (indicated in FIG. 2) of the base 10 and the handle 16 substantially perpendicular to the horizontal surface 12. As noted previously, because of its shape and weighted base, the eating utensil will automatically orient itself into the upright position regardless of its original position. The "wobbling" action that naturally occurs before assuming the upright position is schematically indicated in phantom.

Figure 2:
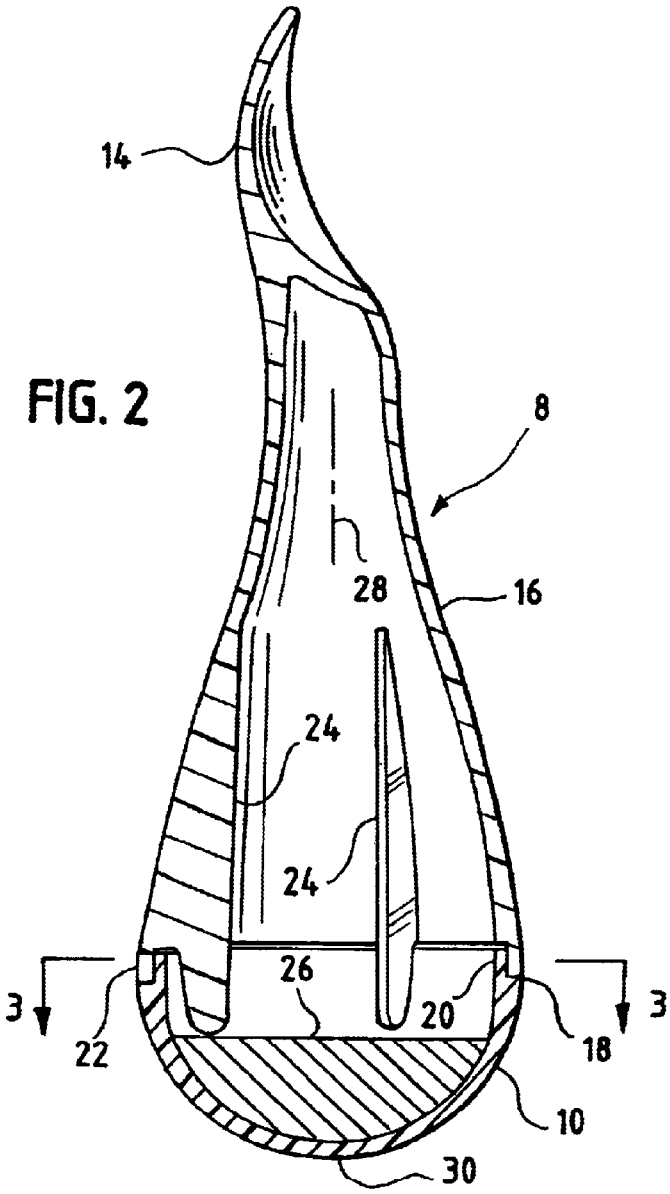
FIG. 2 is a longitudinal cross-sectional view of the eating utensil of FIG. 1.

Referring to FIG. 2, this cross-sectional view shows the base 10 and the handle 16 as being hollow, and illustrates the manner in which the wall of the handle 16 is integral with the head 14. The upper end of the base 10 has an inner lip 20 and adjacent recess which mate with an outer lip 22 and adjacent recess of the lower end of the handle 16, thereby forming outer seam 18. Three equidistantly spaced, internal ribs 24 (only two of which are visible in FIG. 2) are integral with a lower portion of the handle 16. The ribs 24 extend downwardly to lower most tips immediately adjacent to the upper surface of a weight 26 contained within, but not affixed to, the base 10. Accordingly, the ribs 24 function to hold the weight 26 in its desired position. Although in the illustrated embodiment ribs are used to retain the weight within the base, the weight could be retained within, or fixed to, the base in many alternate ways as well, including by an internal collar or wall, by an adhesive, by molding plastic to surround the weight, etc., all encompassed by the present invention.

The above-mentioned longitudinal axis of base 10 and the handle 16 is indicated at 28. The exteriors of base 10 and handle 16 are substantially symmetrical with respect to the longitudinal axis 28. More specifically with regard to the illustrated embodiment, the exterior of the base 10 is substantially hemispherical in shape and the exterior of handle 16 is substantially and peripherally circular in shape in so far as any peripheral boundary thereof in a plane perpendicular to longitudinal axis 28 is substantially circular.

With regard to FIG. 2, although the exterior of the base 10 is substantially rounded (i.e., hemispherical) in shape, such exterior can have a very small flat area 30 at the bottom thereof to assist in stabilizing the eating utensil when resting upon a horizontal surface in the upright position.

Figure 3:
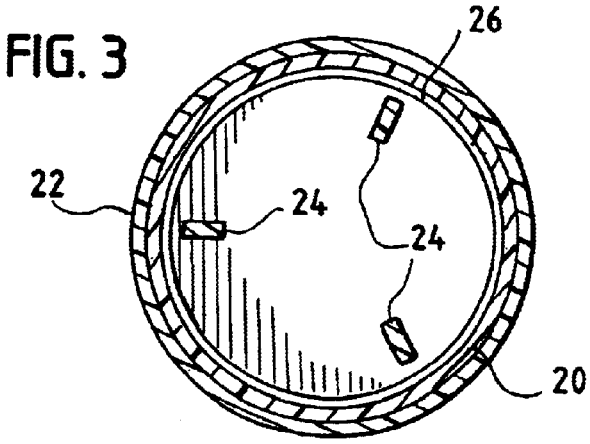
FIG. 3 is a cross-sectional view of the eating utensil taken generally along line 3—3 in FIG. 2.

Referring to FIG. 3, this cross-sectional view shows circular lips 20 and 22 in cross section, portions of all three ribs 24 in cross section, and the circular upper surface of the weight 26.

With respect to materials of construction, the base 10 is preferably composed of a plastic material, and the integrally formed head 14 and the handle 16 are also preferably composed of a plastic material. Of course, other suitably sturdy materials that are non toxic to a child would also be within the scope of the invention. For example, the materials for the base, and/or the head and/or the handle could be rubber, metal, wood or plastic or a combination of any of these materials. The weight 26 is typically composed of a metallic material. Steel is particularly suitable as having a desirable density for the volume that weight 26 occupies within the base 10. Steel is also desirably non toxic to the child in the unlikely event that the base 10 and the handle 16 accidentally break open, thereby allowing weight 26 to fall out of the base.

The eating utensil described above is easily assembled from only three pieces: the base 10, the integrally formed head 14 and the handle 16, and the weight 26. The weight 26 is placed within the base 10, and then the upper end of the base 10 and the lower end of the handle 16 are mated with one another and fixedly connected by any suitable means, such as by ultrasonic welding along outer seam 18.

Suitable parameters for the illustrated and described eating utensil for use by a young child are as follows: height of about 4½ to 5 inches in the upright position; larger handle diameter of about 1 to 1½ inches; small handle diameter of about ⅜ to ½ inch; and a mass for the weight of about 35 to 40 grams. Such specific parameters are given only as an illustrative example, and should not be construed to limit the invention in any manner.

The eating utensil could be scaled up in size for use by a physically handicapped adult who has a limited range of motion in his or her wrist, thus making it difficult to pick up and use a conventional eating utensil.

Many modifications and variations of the present invention are possible in light of the above teachings. Some possible variations include, for example: forming the base and weight at a single, integral piece from a material suitable for an appropriately weighted base; constructing the eating utensil, or at least the base and handle thereof, as an assembly of two identical halves to be secured together along longitudinal seams; and providing a handle with exterior ribs, ridges, finger grips or an otherwise uneven exterior to make it easier to grasp. It may be preferred that the handle member be solid rather than hollow. In the spoon embodiment, the head could include a small weep hole through a center thereof to assist in holding food onto the spoon. It is therefore, to be understood that within the scope of the appended claims, the invention can be practiced otherwise then as specifically described.

Figure 4:
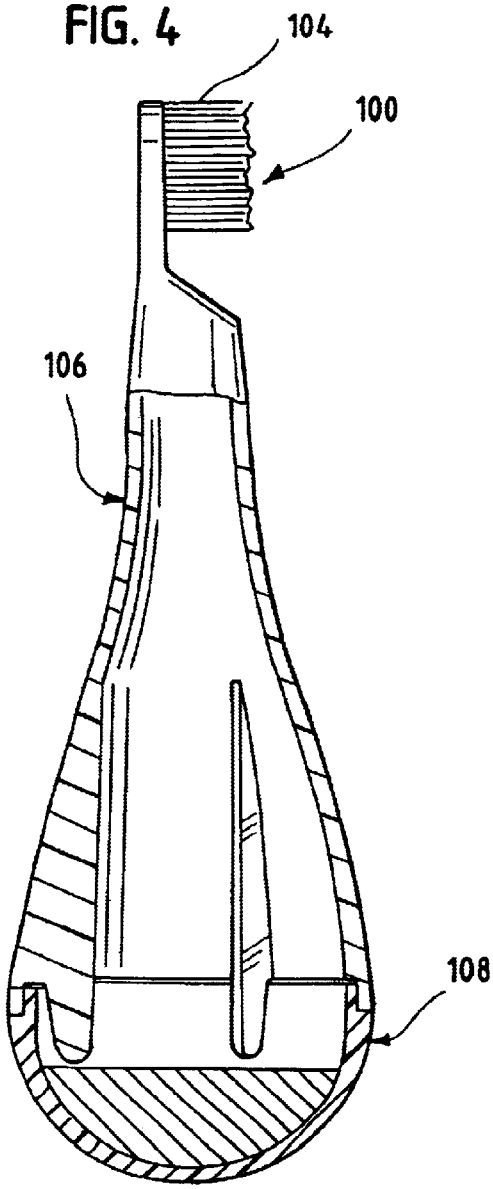
FIG. 4 is an elevational view shown partially in cross-section of the hand held implement of the invention, embodied as a toothbrush.

FIG. 4 illustrates a second illustrated embodiment of the hand held implement of the present invention. In this illustrated embodiment, the implement is embodied as a toothbrush 100 having: a brush head 104, as the working end portion, a handle member 106, and a weighted base 108. As previously described, the weighted base is substantially rounded and convex, preferably hemispherical.

Figure 4A:
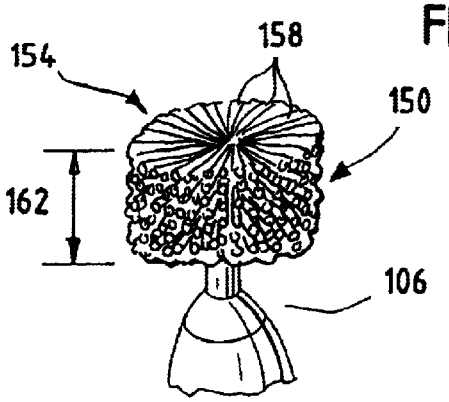
FIG. 4A is a fragmentary, perspective view of an alternate embodiment toothbrush head.

FIG. 4A illustrates an alternate toothbrush 150 having an alternate brush head 154. The handle 106 and the base (not shown) can be identical to that shown and described in FIG. 4. According to the alternate embodiment, the brush head 154 includes a plurality of radially extending bristles 158 forming an all-around (360°) brush having a length 162. The all-around brush head 154 is more easily used by a child, for example, to clean all areas of his or her teeth. Unlike a conventional toothbrush head, there is no need for precise angular insertion and control inside the child's mouth. Additionally, since the brush head 154 can be supported on the automatic-righting handle and base of the invention, the problem of resting the brush head directly on a support surface, and resultant contamination of the support surface, or the contamination of the brush head is avoided.

Figure 5:
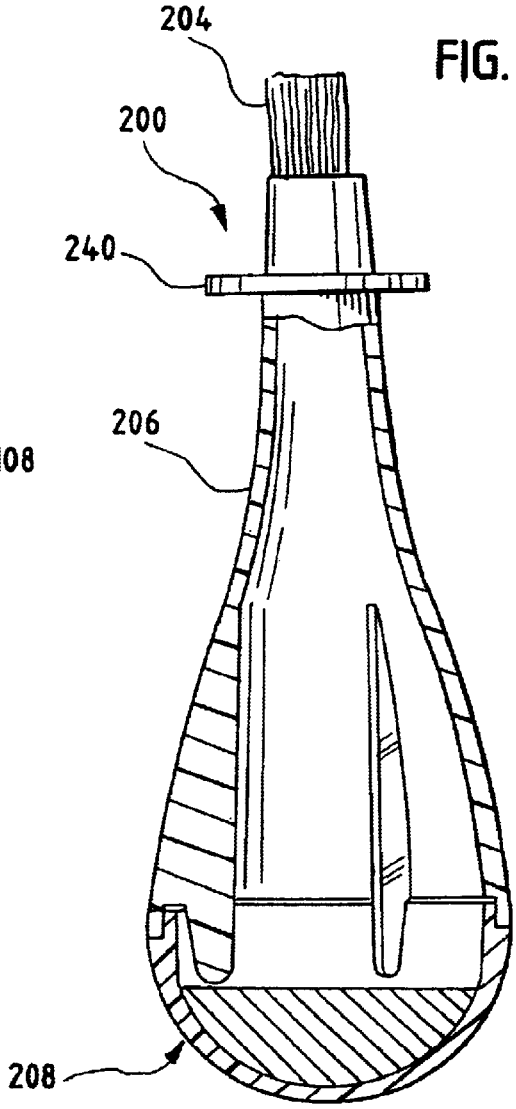
FIG. 5 is an elevational view shown partially in cross-section of the hand held implement of the invention, embodied as a paintbrush.

FIG. 5 illustrates a third illustrated embodiment of the hand held implement of the present invention, embodied as a paintbrush 200 having: a brush head 204, as the working end portion, a handle member 206, and a weighted base 208. As previously described, the weighted base is substantially rounded and convex, preferably hemispherical.

In the case of FIGS. 4, 4A and 5, the weighted base causes the implements 100, 200 to be automatically righted to their vertical position when supported on a horizontal surface. In all respects, except for the different heads at the working ends, the embodiments of FIGS. 4, 4A and 5 can be configured similarly to the eating utensil described above with regard to FIGS. 1 through 3.

As illustrated in FIG. 5, a drip shield or drip ring 240 can be provided beneath the brush head 204 to catch drips while the implement is vertically oriented. The drip ring 240 can be incorporated into any of the implements described in the present application.

Figure 6:
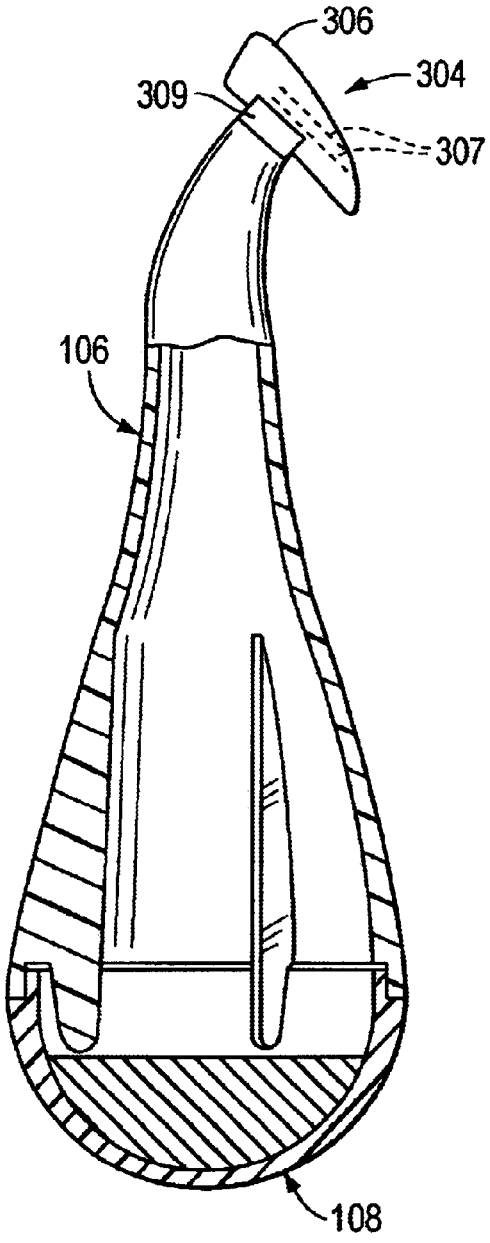
FIG. 6 is an elevational, partially schematic, view shown partially in cross-section of the hand held implement of the invention, embodied as a shaving razor.

As an alternative, FIG. 6 illustrates a shaving razor substantially incorporating the handle 106, and base 108 of FIG. 4 but including a razor head 304 instead of a brush head. The razor head 304 is configured, as is known, to hold shaving razor blades. The blades can be replaceable or non-replaceable. The razor head can be configured as a replaceable cartridge 306. The cartridge 306 is illustrated (schematically) carrying twin blades 307. A known mechanism, shown schematically as 309, can be used to releasably hold the cartridge 306, fixedly or with some freedom to pivot, to the handle 106. Further alternatively, the entire shaving razor of FIG. 6 could be configured with the razor head 304, the handle member 106, and the weighted base 108 being formed or assembled together to be disposable as a unit. In this regard, the razor head 304, the handle member 106, and the weighted base 108 could be composed of a unitary plastic part, with an added weight as necessary, or assembled parts.

Although FIG. 6 illustrates a manually operated shaving razor, an electric or battery powered shaving razor could also incorporate the self-righting concept of the invention, such as by use of the handle 106 and the base 108 shown in FIG. 6. Electrical or electronic circuitry and/or a battery could be housed at least in part within the handle and base. The embodiment may be particularly suited for mustache and nose hair trimmers.

Figure 7:
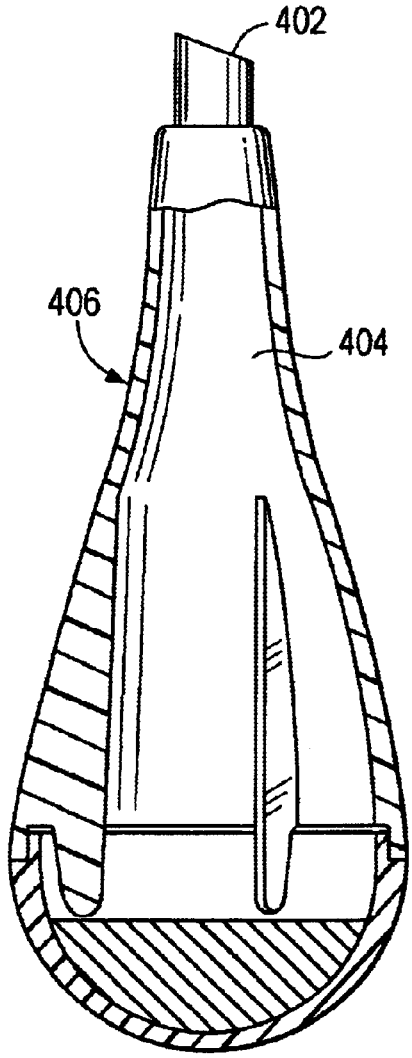
FIG. 7 is an elevational view shown partially in corss-section of the hand held implement of the invention, embodied as a marker.

Although a few types of implements are illustrated in the Figures, other implements are encompassed by the invention. Such implements include, but are not limited to: other eating or serving utensils; tools; tools such as screwdrivers; flashlights; fine work tools such as for jewelry, electronics, assembly and model making work; writing instruments; markers; art implements; medical and dental instruments; beauty implements such as makeup brushes, makeup applicators and grooming tools; and other hand held implements. In each case, the implement includes a rounded weighted base, a handle, and a working end portion. For example, in the case of a flashlight, the working end portion would be a light bulb and the batteries could be held within a hollow handle. In the case of a marker, as shown in FIG. 7, the working end portion would be the felt tip applicator 402, and an ink supply or cartridge 404 could be held within the hollow handle 406.

Although the illustrated embodiments describe the working end portion or head as being integrally formed with the handle, the working end portion could be releasably attached to the handle. The releasable attachment could be configured as a plug-and-socket, snap fit arrangement such as used in socket wrench tools, for example. The working end portion can be replaced when worn out, or a number of different working end portions could be interchangeably attachable to a universal, or common, handle and weighted base assembly. For example, a number of different tools can be provided in a set with a single handle and base.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A hand held marking implement, comprising:

a weighted base having a substantially rounded and convex exterior, and being of a mass and dimension to automatically orient said marking implement in a vertical orientation when placed upon a horizontal surface;

a marking end portion spaced from said base, said marking end portion configured for applying a coating to a work surface; and a handle extending between, and connected to, the base and said marking end portion.

2. The marking implement according to claim 1, wherein said handle has an exterior with a maximum diameter adjacent to the base, and a minimum diameter adjacent to the head.

3. The marking implement according to claim 1, wherein said handle is integrally connected to the base and to said marking end portion.

4. The marking implement according to claim 1, wherein one of said marking end portion or said handle is removably attached to be replaceable with respect to said base.

5. The marking implement according to claim 1, wherein said base and said handle have a common longitudinal axis that is substantially perpendicular to the horizontal surface when said marking implement is in its upright position.

6. The marking implement according to claim 5, wherein said exterior of said base and said handle are substantially symmetrical with respect to the longitudinal axis.

7. The marking implement according to claim 6, wherein said exterior of said base is substantially hemispherical in shape.

8. The marking implement according to claim 1, wherein when oriented in its upright position, said base has an upper end having a base diameter and said handle has a lower end having a lower end diameter equal to said base diameter and fixedly connected to said upper end of said base.

9. The marking implement according to claim 8, wherein said handle has an upper portion which is integral with said marking end portion.

10. The marking implement according to claim 1, wherein said base is composed of a plastic material on an outside thereof, and wherein said marking end portion and said handle are integrally formed from a plastic material.

11. The marking implement as recited in claim 1, wherein said base comprises a hollow shell and a weight held within said hollow shell.

12. The marking implement according to claim 1, wherein said marking end portion comprises a soft tip and at least one of said handle and said base encloses a supply of marking fluid in fluid communication with said soft tip.

13. The marking implement according to claim 1, wherein said marking implement comprises a makeup applicator.

14. The marking implement according to claim 1, wherein said marking implement comprises a paintbrush, said marking end portion comprising bristles.

15. The marking implement according to claim 1, wherein said marking implement comprises a makeup brush.

16. The marking implement according to claim 1, wherein said marking end portion comprises a plurality of longitudinally extending bristles.

17. The marking implement according to claim 1, wherein said marking end portion comprises a writing implement.

18. The marking implement according to claim 1, wherein said marking end portion comprises an art implement.

19. The marking implement according to claim 1, further comprising a drip shield extending radially from said handle.

20. The marking implement according to claim 1, wherein said base and said handle are fixed together to form a hollow shell and said base comprises a weight herd within said hollow shell.

* * * * *